US006470685B2

(12) United States Patent
Pidcock et al.

(10) Patent No.: US 6,470,685 B2
(45) Date of Patent: Oct. 29, 2002

(54) COMBUSTION APPARATUS

(75) Inventors: Anthony Pidcock, Derby (GB); Desmond Close, Derby (GB); Michael P Spooner, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/826,927

(22) Filed: Apr. 6, 2001

(65) Prior Publication Data

US 2001/0029738 A1 Oct. 18, 2001

(30) Foreign Application Priority Data

Apr. 14, 2000 (GB) ..... 0009166

(51) Int. Cl.[7] ..... F23R 3/60
(52) U.S. Cl. ..... 60/752; 60/757
(58) Field of Search ..... 60/752, 753, 755, 60/757

(56) References Cited

U.S. PATENT DOCUMENTS 4,695,247 A 9/1987 Enzaki
5,216,886 A 6/1993 Ewing
5,605,046 A * 2/1997 Liang ..... 60/752
5,799,491 A * 9/1998 Bell et al. ..... 60/752
6,029,455 A * 2/2000 Sandelis ..... 60/755

FOREIGN PATENT DOCUMENTS

GB 2 298 266 A 8/1996
GB 2 317 005 A 3/1998

* cited by examiner

*Primary Examiner*—Michael Koczo
(74) *Attorney, Agent, or Firm*—Warren Taltavul; Manelli Denison & Selter PLLC

(57) ABSTRACT

A wall structure for a gas turbine combustor arranged to have a general direction of fluid flow therethrough includes inner and outer walls defining a space therebetween. The inner wall is made up of a plurality of tiles having axial edges aligned generally with the direction of fluid flow, a gap being defined between axial edges of adjacent tiles. Orifices are provided within the axial edges to direct leakage air passing through the gaps to give the leakage air a flow component in the general direction of fluid flow through the combustor.

17 Claims, 3 Drawing Sheets

COMBUSTION APPARATUS

The invention relates to a combustion apparatus for a gas turbine engine. More particularly the invention relates to a wall structure for such a combustion apparatus, and to a wall element for use therein.

A typical gas turbine engine combustor includes a generally annular chamber having a plurality of fuel injectors at an upstream head end. Combustion air is provided through the head and in addition through primary and intermediate mixing ports provided in the combustor walls, downstream of the fuel injectors.

In order to improve the thrust and fuel consumption of gas turbine engines, i.e. the thermal efficiency, it is necessary to use high compressor pressures and combustion temperatures. This results in the combustion chamber experiencing high temperatures and there is therefore a need to provide effective cooling of the combustion chamber walls. Various cooling methods have been proposed including the provision of a doubled walled combustion chamber whereby cooling air is directed into a gap between spaced outer and inner walls, thus cooling the inner wall. This air is then exhausted into the combustion chamber through apertures in the inner wall. The exhausted air forms a cooling film which flows along the hot, internal side of the inner wall, thus preventing the inner wall from overheating.

The inner wall may comprise a number of heat resistant tiles, such a construction being relatively simple and inexpensive. The tiles are generally rectangular in shape and curved to conform to the overall shape of the annular combustor wall. The tiles are conventionally longer in the circumferential direction of the combustor than in the axial direction.

The tiles are typically of cast construction, while the outer "cold" wall of the combustor wall structure is typically of sheet metal. Neither of these production methods produces components to very high tolerances and this inevitably results in gaps between adjacent tiles. It is also necessary to leave gaps between the edges of adjacent tiles, particularly the axially directed edges, in order to allow for expansion of the tiles in hot conditions. The air in the gap between the tiles and the outer cold wall is at a higher pressure than that inside the combustion chamber, and it is therefore inevitable that cooling air will leak into the combustion chamber through the axial gaps between adjacent circumferentially spaced tiles. The leaked air tends to form a relatively stiff, inwardly directed "wall" of air, which has a detrimental effect on the quality of the cool air film provided along the hot side of the tiles. As a result, overheating of the tiles may occur immediately downstream of the axial gap.

According to the present invention there is provided a wall structure for a gas turbine engine combustor arranged to have a general direction of fluid flow therethrough, the wall structure including inner and outer walls, the inner and outer walls define a space therebetween, wherein the inner wall includes a plurality of wall elements, the plurality of wall elements include axial edges aligned generally with the direction of fluid flow, a gap being defined between adjacent axial edges of adjacent tiles, and wherein means are provided for directing leakage air passing through the gaps such that the leakage air has a flow component in the general direction of fluid flow through the combustor.

Preferably at least one wall element includes a body portion and an axial edge portion, the body portion conforming to the general shape of the combustor wall structure and the axial edge portion including a member, the member extending from the body portion towards the outer wall of the combustor wall structure. The member may extend in a generally radial direction of the combustor.

The means for directing the leakage air may include at least one orifice, the at least one orifice provided in the axial edge portion of the wall element. Preferably the at least one orifice is provided in the member which extends from the body portion towards the outer wall of the combustor wall structure.

Preferably the orifices are directed at an angle of between 5° and 70° to the general direction of fluid flow through the combustor. Most preferably the orifices are directed at an angle of between 10° and 45° to the general direction of fluid flow through the combustor.

Preferably the at least one orifice lies generally parallel to the inner wall of the wall structure. The orifices may be cast into the wall element. Alternatively the orifices may be laser drilled into the wall element.

The axial edge portion may include a portion, the portion in use being overlapped by an axial edge portion of an adjacent wall element.

The wall structure may comprise at least two adjacent wall elements including peripheral edges, the edges being aligned generally across the direction of fluid flow, a gap being provided between adjacent peripheral edges of the adjacent wall elements, and wherein means are provided for directing leakage air passing through the gap such that the leakage air has a flow component in the general direction of fluid flow through the combustor. At least one wall element comprises a peripheral edge portion and a body portion, the edge portion including a member, the member extending from the body portion of the wall element towards the outer wall of the combustor wall structure, and the means for directing the leakage air may be provided within this member.

The wall element may be adapted for use in conjunction with other similar wall elements to form a wall structure.

According to the present invention there is further provided a wall element for use as part of an inner wall of a gas turbine engine combustor wall structure including inner and outer walls, the inner and outer walls defining a space therebetween, the wall element including axial edges, the axial edges aligned in use with a general direction of fluid flow through the combustor, wherein the wall element includes means associated with the axial edges for directing leakage air passing around the axial edges such that the leakage air has a flow component in the general direction of fluid flow through the combustor.

The wall element may include a body portion and an axial edge portion, the body portion conforming to the general shape of the combustor wall structure and an axial edge portion including a member, the member extending in use from the body portion towards the outer wall of the combustor wall structure, and wherein the means for directing leakage air includes at least one orifice, the at least one orifice provided in the axial edge portion of the tile.

According to the invention, there is further provided a gas turbine engine combustion chamber including a wall structure or wall element as defined in any of the preceding ten paragraphs.

Embodiments of the invention will be described for the purpose of illustration only with reference to the accompanying drawings, in which.

Figure 1:
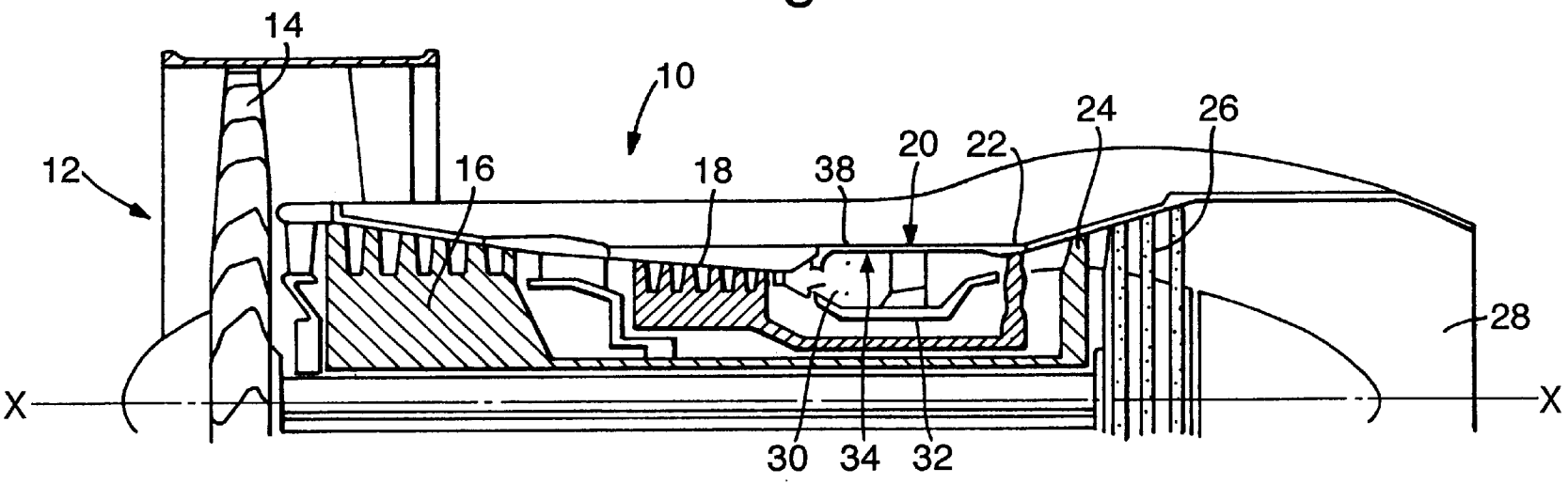
FIG. 1 is a schematic diagram of a ducted fan gas turbine engine having an annular combustor.

With reference to FIG. 1 a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine engine 10 works in the conventional manner so that air entering the intake 12 is accelerated by the fan 14 to produce two air flows, a first air flow into the intermediate pressure compressor 16 and a second airflow which provides propulsive thrust. The intermediate pressure compressor 16 compresses the air flow directed into it before delivering the air to the high pressure compressor 18 where further compression takes place.

The compressed air exhausted from the high pressure compressor 18 is directed into the combustion equipment 20 where it is mixed with fuel and the mixture combusted. The resultant hot combustion products then expand through and thereby drive the high, intermediate and low pressure turbines 22, 24 and 26 before being exhausted through the nozzle 28 to provide additional propulsive thrust. The high, intermediate and low pressure turbines 22, 24 and 26 respectively drive the high and intermediate pressure compressors 16 and 18 and the fan 14 by suitable interconnecting shafts.

The combustion equipment 20 includes an annular combustor 30 having radially inner and outer wall structures 32 and 34 respectively. Fuel is directed into the combustor 30 through a number of fuel nozzles (not shown) located at the upstream end of the combustor 30. The fuel nozzles are circumferentially spaced around the engine 10 and serve to spray fuel into air derived from the high pressure compressor 18. The resultant fuel and air mixture is then combusted within the combustor 30.

The combustion process which takes place within the combustor 30 generates a large amount of heat. Temperatures within the combustor may be between 1,850K and 2,600K. It is therefore necessary to ensure that the inner and outer wall structures 32 and 34 are capable of withstanding these temperatures while functioning in a normal manner. The radially outer wall structure 34 can be seen more clearly in FIG. 2.

Figure 2:
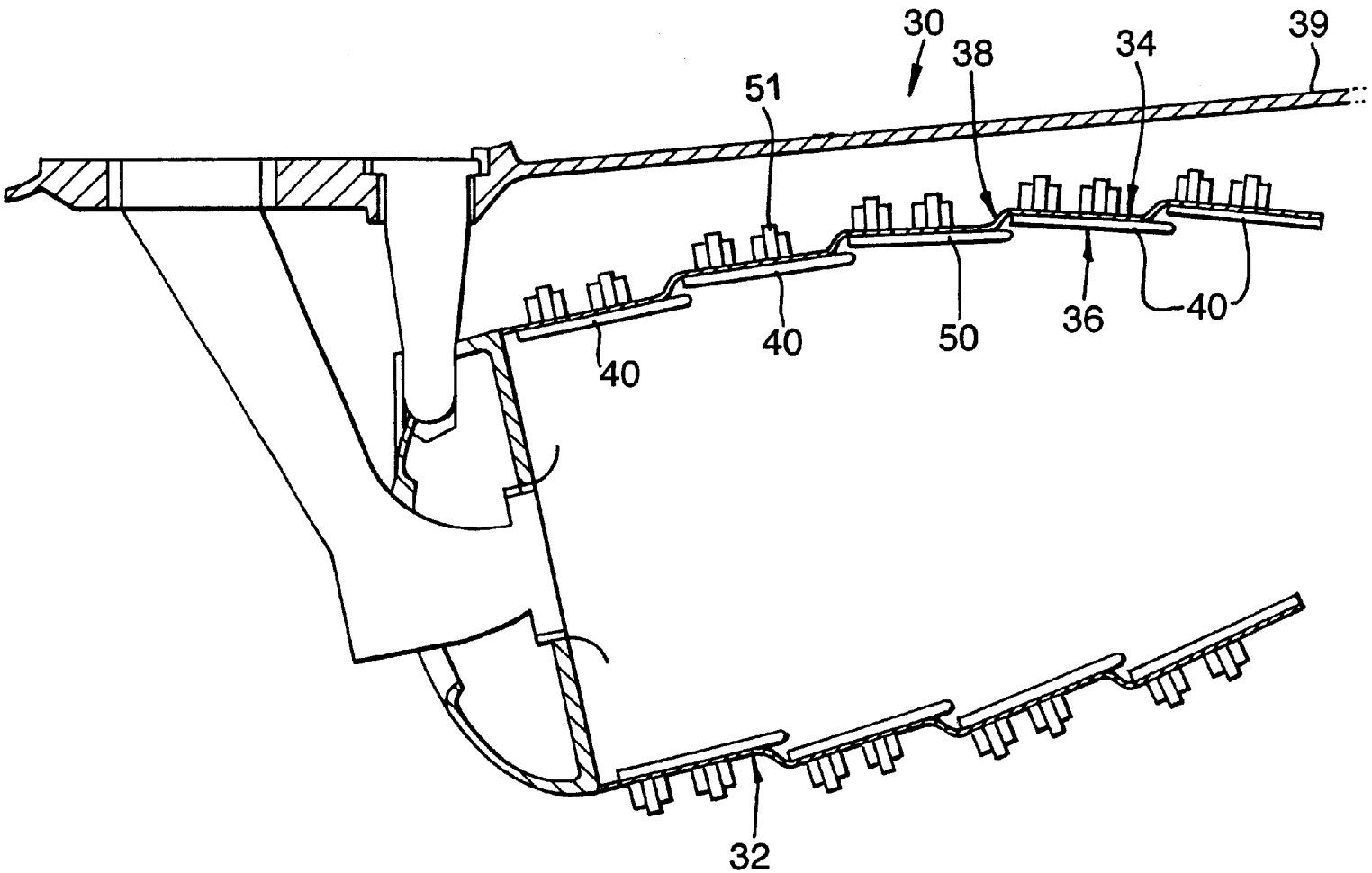
FIG. 2 is a diagrammatic cross section of an annular combustor.

Referring to FIG. 2, the wall structure 34 includes an inner wall 36 and an outer wall 38. The inner wall 36 comprises a plurality of discrete tiles 40 which are all of substantially the same rectangular configuration and are positioned adjacent each other. The majority of the tiles 40 are arranged to be equidistant from the outer wall 38. Each tile is conventionally of cast construction and is longer in the circumferential direction than in the axial direction of the combustor.

The pressure of the air in a feed annulus defined between the outer wall 38 and combustor casing 39 is about 3% to 5% higher than the pressure within the combustor (perhaps 600 psi as opposed to 570 psi). The air temperature outside the combustor is about 800K to 900K. Feed holes (not illustrated) may be provided in the outer wall 38 such that high pressure, relatively cool air flows into a space 50 between the tiles 40 and the outer wall 38. Angled effusion holes (not illustrated) may be provided within the tiles 40 such that the cooling air flows through the tiles 40 and forms a cool air film over the hot, internal surface of the tiles. This air film prevents the tiles 40 from overheating.

The cooling film flows over the tiles 40 in the general direction of fluid flow through the combustor, i.e. to the right as shown in FIG. 2.

Figure 3:
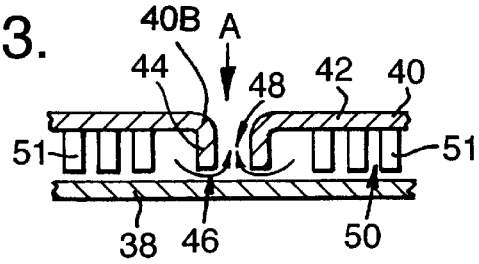
FIG. 3 is a partial circumferential cross section through two adjacent combustor wall tiles, according to the prior art.

Referring to FIG. 3, the tiles 40 are provided with upstanding pedestals 51, which extend into the gap 50. The air within the gap 50 flows over and around the pedestals 51, this further helping to cool the tiles 40 and prevent overheating.

Still referring to FIG. 3, each tile 40 includes a main body 42 which is shaped to conform to the general shape of the combustor wall structure. At an axially extending peripheral edge 40*b* of each tile, a sealing rail 44 extends from the main body 42 of the tile towards the outer wall 38. There may be a small gap 46 between the sealing rail 44 of each tile and the outer wall 38 due to manufacturing tolerances. Adjacent sealing rails 44 of adjacent tiles 40 are located a small distance apart, resulting in a gap 48.

Figure 4:
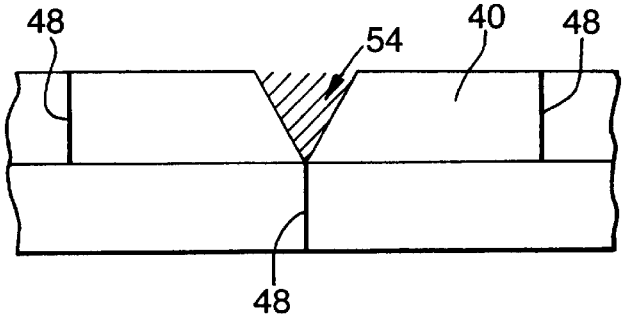
FIG. 4 is a diagrammatic view in the direction of the arrow A in FIG. 3.
Figure 5:
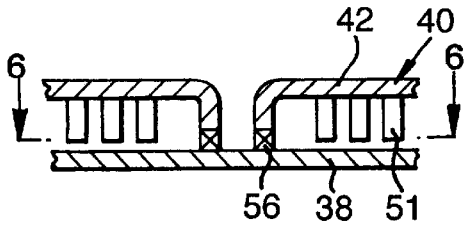
FIG. 5 is a partial diagrammatic circumferential cross section through two adjacent combustor wall tiles, according to a first embodiment of the invention.
Figure 6:
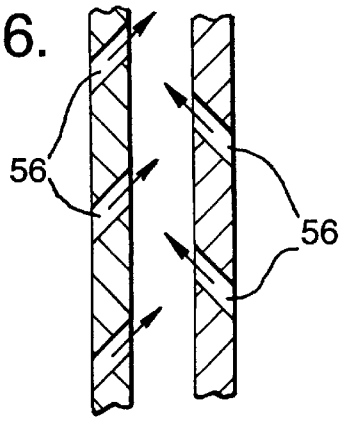
FIG. 6 is a diagrammatic cross section along the line 6—6 view in the direction of the arrow 6 in FIG. 5.

Because the pressure within the space 50 between the tiles 40 and the outer wall 38 is higher than the pressure within the combustor 30, air leaks from the space 50 through the gaps 46 and 48 into the combustor 30. Referring to FIG. 4, a substantially planar "wall" of leakage air forms inwardly of the axial gap 48. This wall of air disrupts the cooling air film provided on the inner hot side of the tiles 40. The film is particularly disrupted in a region 54 just downstream of the axial gap FIGS. 5 and 6 illustrate the axial sealing rail 44 of two adjacent tiles 40 according to the invention. Each sealing rail 44 is provided with a plurality of substantially cylindrical orifices 56 angled in the range of between 5° and 70° and preferably approximately 40° and 50° to the general direction of flow within the combustor 30. The orifices 56 control the direction of flow of the leakage air, preventing it from leaving the gap 48 in a radial direction and instead causing it to flow generally along and parallel to the inner wall of the tiles 40.

The orifices 56 prevent the formation of a sheet or wall of air internally of the axial gaps 48 and instead result in the provision of a controlled flow of air traveling generally with the existing air film. The orifices 56 also result in cooling of the sealing rails 44, which minimizes distortion of the sealing rails and further reduces uncontrolled leakage of air.

Figure 7:
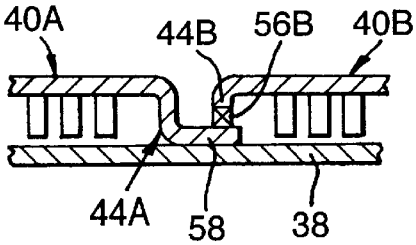
FIG. 7 is a partial diagrammatic circumferential cross section through two adjacent combustor wall tiles, according to a second embodiment of the invention.

FIG. 7 illustrates an alternative embodiment of the invention, in which a sealing rail 44A of a tile 40A is modified to further minimize/control leakage. The sealing rail 44A includes an additional foot portion 58, lying generally adjacent and parallel to the outer wall 38 in use. An adjacent tile 40B includes a sealing rail 44B provided with orifices 56B similar to those illustrated in FIG. 6. The sealing rail 44B is able to move circumferentially relative to the foot portion 58, by sliding over the foot portion. Thus the embodiment of FIG. 7 still allows circumferential expansion of the tiles 40A, 40B but the foot portion 58 minimizes uncontrolled leakage between the outer wall 38 and the tile sealing rails 44A, 44B.

The orifices 56 may be formed in the tile during the casting process. Alternatively, the orifices may be cut (for example by laser drilling) into the tiles after casting or may be formed by any other manufacturing process.

There is thus provided a tile which causes the leakage air flow to have a downstream component and thus minimizes the damage that it does to the cool air film located along the inside of the inner wall. This minimizes problems of overheating caused downstream of the axial gaps between adjacent tiles. Because the leakage is controlled, it may be possible to allow relatively more of a pressure drop across the tiles 40 and relatively less across the outer wall 38. Allowing a greater pressure drop across the tiles 40 can result in the provision of an enhanced cooling air film on the internal side of the tiles and enhanced heat removal from the external tile surface, thus minimizing the risk of the structure overheating.

Various modifications may be made to the above described embodiments without departing from the scope of the invention. The precise shapes of the tiles may be modified. In particular, the shapes and orientations of the orifices may be modified, provided that they result in the leakage air having a downstream component of flow. In tiles incorporating peripheral sealing rails along their circumferentially directed edges, orifices may also be provided in these sealing rails.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A wall structure for a gas turbine engine combustor arranged to have a general direction of fluid flow therethrough, the wall structure including inner and outer walls, the inner and outer walls defining a space therebetween, wherein the inner wall includes a plurality of wall elements, the plurality of wall elements include axial edges, the axial edges being aligned generally with the direction of fluid flow, a gap being defined between adjacent axial edges of adjacent wall elements, and wherein means are provided for directing leakage air passing through the gaps such that the leakage air has a flow component in the general direction of fluid flow through the combustor.

2. A wall structure according to claim 1 wherein at least one wall element includes a body portion and an axial edge portion, the body portion conforming to the general shape of the combustor wall structure and the axial edge portion including a member, the member extending from the body portion towards the outer wall of the combustor wall structure.

3. A wall structure according to claim 2 wherein the member extends in a generally radial direction of the combustor.

4. A wall structure according to claim 2 wherein the means for directing the leakage air includes at least one orifice, the at least one orifice provided in the axial edge portion of the wall element.

5. A wall structure according to claim 4 wherein the at least one orifice is provided in the member which extends from the body portion towards the outer wall of the combustor wall structure.

6. A wall structure according to claim 4 or claim 5 wherein the orifices are directed at an angle of between 5° and 70° to the general direction of fluid flow through the combustor.

7. A wall structure according to claim 6 wherein the orifices are directed at an angle of between 10° and 45° to the general direction of fluid flow through the combustor.

8. A wall structure according to claim 4 wherein the at least one orifice lies generally parallel to the inner wall of the wall structure.

9. A wall structure according to claim 4 wherein the at least one orifice is cast into the wall element.

10. A wall structure according to claim 4 wherein the at least one orifice is laser drilled into the wall element.

11. A wall structure according to claim 2 wherein the axial edge portion includes a portion, the portion in use being overlapped by an axial edge portion of an adjacent wall element.

12. A wall structure according to claim 1, wherein at least two adjacent wall elements include peripheral edges, the peripheral edges being aligned generally across the direction of fluid flow, a gap being provided between adjacent peripheral edges of the adjacent wall elements, and wherein means are provided for directing leakage air passing through the gap such that the leakage air has a flow component in the general direction of fluid flow through the combustor.

13. A wall structure according to claim 12 wherein at least one wall element comprises a circumferential edge portion and a body portion, the circumferential edge portion including a member, the member extending from the body portion of the wall element towards the outer wall of the combustor wall structure and wherein the means for directing leakage air is provided within the member.

14. A gas turbine engine combustion chamber including a wall structure according to claim 1.

15. An elemental wall structure according to claim 1 wherein a single wall element is adapted for use in conjunction with other similar wall elements.

16. A wall element for use as part of an inner wall of a gas turbine engine combustor wall structure including inner and outer walls, the inner and outer walls defining a space therebetween, the wall element including axial edges, the axial edges aligned in use with a general direction of fluid flow through the combustor, wherein the wall element includes means associated with the axial edges for directing leakage air passing around the axial edges such that the leakage air has a flow component in the general direction of fluid flow through the combustor.

17. A wall element according to claim 16 wherein the wall element includes a body portion and an axial edge portion, the body portion conforming to the general shape of the combustor wall structure, the axial edge portion including a member, the member extending in use from the body portion towards the outer wall of the combustor wall structure, and wherein the means for directing leakage air includes at the least one orifice, the at least one orifice provided in the axial edge portion of the tile.

* * * * *